United States Patent [19]

Peterson et al.

[11] Patent Number: 4,488,468

[45] Date of Patent: Dec. 18, 1984

[54] ELECTRONIC MUSICAL INSTRUMENT AND COMPACT PEDAL BOARD AND STORAGE CASE THEREFOR

[75] Inventors: Richard H. Peterson, 11748 Walnut Ridge Dr., Palos Park, Ill. 60464; Patrick J. Bovenizer, Alsip; Richard W. Jensen, Elmhurst; William H. Hass, Hickory Hills, all of Ill.

[73] Assignee: Richard H. Peterson, Palos Park, Ill.

[21] Appl. No.: 271,762

[22] Filed: Jun. 9, 1981

[51] Int. Cl.[3] ..... G10H 1/34

[52] U.S. Cl. ..... 84/1.01; 84/DIG. 3; 84/DIG. 25; 200/86.5; 361/331; 361/380

[58] Field of Search ..... 84/1.01, 1.19, DIG. 3, 84/DIG. 25; 200/86.5; 361/331, 380

[56] References Cited

U.S. PATENT DOCUMENTS

| | | | |
|---|---|---|---|
| 1,882,960 | 10/1932 | Sater | 84/DIG. 3 |
| 3,585,893 | 6/1971 | Arseneault | 84/DIG. 25 |
| 3,962,945 | 6/1976 | Creager et al. | 84/1.01 |
| 4,278,004 | 7/1981 | Klann | 84/426 X |
| 4,322,995 | 4/1982 | Tavel | 84/1.19 |

*Primary Examiner*—Stanley J. Witkowski

*Attorney, Agent, or Firm*—Jones, Tullar & Cooper

[57] ABSTRACT

An electronic musical instrument including a compact, portable pedal board and a storage case for the pedal board and for the electronic components of the instrument is disclosed. The pedal board includes shortened foot pedals having a low profile and a very low throw for activating control switches for the electronics, whereby the pedal board can be used in conjunction with a piano or with other instruments. The low throw is obtained through the use of a guide channel mounting arrangement for the pedals and by the use of pressure sensitive switching.

The storage case receives and secures the pedal board and also provides a housing for the tone generator, amplifier and other electronics controlled by the pedal board. A control panel door on the end of the storage case is adapted to receive a control panel, and is hinged to the storage case so that it may be swung fully open to expose the control panel. The case may then be positioned on its opposite end to serve as a display stand for the control unit. The control panel door may be completely separable from the case so that the control panel may be mounted at a remote location.

17 Claims, 9 Drawing Figures

ELECTRONIC MUSICAL INSTRUMENT AND COMPACT PEDAL BOARD AND STORAGE CASE THEREFOR

BACKGROUND OF THE INVENTION

The present invention relates, in general, to electronically operated musical instruments, and more particularly to a compact pedal board and storage case for use in electronically producing a musical accompaniment to other musical instruments.

Electronically produced musical sounds such as those of the string bass have been found to be particularly desirable as an accompaniment to other musical instruments, and has been found to provide a particularly good accompaniment for a solo pianist. String bass sounds can be produced electronically by means of conventional foot-operated pedals, and the provision of such an instrument with a piano would enable a pianist to accompany himself and eliminate the need for a second player. However, a piano, unlike an organ, is not designed for use with foot pedals, for the keyboard and the bench are lower than is the case with an organ, and the kneeboard is closer to the player. Conventional pedals are not suitable for this purpose not only because there is not room for them in front of the kneeboard, but because they require a throw, or vertical motion, of about one inch to activate the electronic circuitry. Such a long throw would require the player to lift his leg off the piano bench in order to play the pedal board, and this is extremely uncomfortable and tiring for the player.

Ordinarily, in an instrument such as an organ, the pedal keys would extend beyond the kneeboard and into the interior of the organ casing. This arrangement allows a convenient location of the pivot mechanism near the middle of the pedals and allows the electrical contacts to be conveniently located at the back of the pedal. Such pedals are usually pivotally mounted on a flexible, flat, steel spring, this arrangement providing a great degree of side-to-side strength and keeping the pedals properly aligned even if they are accidentally kicked by the player. However, such a structure requires a relatively high throw in order to activate the electrical contacts normally located at the far, or rearward end of the pedal, inside the organ housing. This structure is not suitable for a piano, and attempts to make such boards smaller to adapt them to this use has resulted in board that are susceptible to damage and misalignment during use, and with a weakened overall construction.

Thus, conventional pedal boards are not suitable for use with pianos and attempts to adapt existing pedals to such use have encountered serious problems of pedal strength, alignment, excessive pedal throw, and uncertain electrical contact operation.

Although electronic musical instruments usually do not involve complex mechanical structures, they often require a number of components which must be assembled and disassembled each time the instrument is used. This is not only time consuming, but produces an unslightly collection of wires and boxes that are hazardous and that can be easily lost or damaged.

SUMMARY OF THE INVENTION

It is, therefore, an object of the present invention to produce a small, compact, pedal board that can be used with existing pianos of any kind, as well as with other instruments, and more particularly to provide a string bass pedal board for use by a pianist in providing an electronically generated string bass musical accompaniment.

Another object of the invention is to provide a compact pedal board that can be used with a reasonable degree of comfort with a piano, without sacrificing mechanical strength.

A further object of the invention is to provide a combination pedal board and storage case for use in electronically producing musical sounds.

Another object of the invention is to provide an electronic musical instrument having, in combination, a pedal board and a storage case therefor, wherein the pedal board is adapted to be removably mounted within the carrying case and wherein the storage case provides a convenient and compact housing and control panel display stand for the electronic equipment used with the pedal board, so that the instrument may be easily assembled and disassembled for the production of musical sounds.

Briefly, the present invention provides a compact pedal board having a plurality of pedal keys wherein each pedal key is pivotally mounted to move within a U-shaped channel member. The pedal keys pivot about shafts located at their rearward ends so that the forward ends of the pedal keys, where the player's feet contact them, has a very low throw. Pressure-sensitive contacts are located at the forward ends of the pedal keys so that very little motion is required to activate them. The U-shaped channel members provide side-to-side strength so that the pedal keys are not easily displaced, even though the pivot location does not provide optimum strength, and can withstand the normal heavy use such pedal boards encounter. The pedal board thus has an extremely low profile and the pedal keys are relatively short so that the board can be used in combination with a piano without discomfort to the pianist, while having the required strength to withstand accidental kicks. Although the contacts are located at the forward ends of the keys, they are so constructed as to resist damage even if the full weight of the player is placed on them.

The small size of the pedal board permits it to be stored in a compact storage case which also provides a housing for the electronic musical instrument components to be controlled by the pedal board. The storage case includes a control panel door, which preferably is a segment of one end of the case. The door may be folded open to display a control panel mounted thereon, with the segment of the case used for this purpose being so selected that when the case stands upright on its opposite end, it provides a display stand for the controls. This provides a further convenience to the pianist, since the case is of such a size that the controls are located for easy reach. If desired, the control panel door can be removed from the case for mounting on a suitable bracket secured to the piano.

BRIEF DESCRIPTION OF THE DRAWINGS

The foregoing and additional objects, features, and advantages of the present invention will become apparent from a consideration of the following detailed description thereof taken in conjunction with the accompanying drawings, in which.

DESCRIPTION OF PREFERRED EMBODIMENTS

Figure 1:
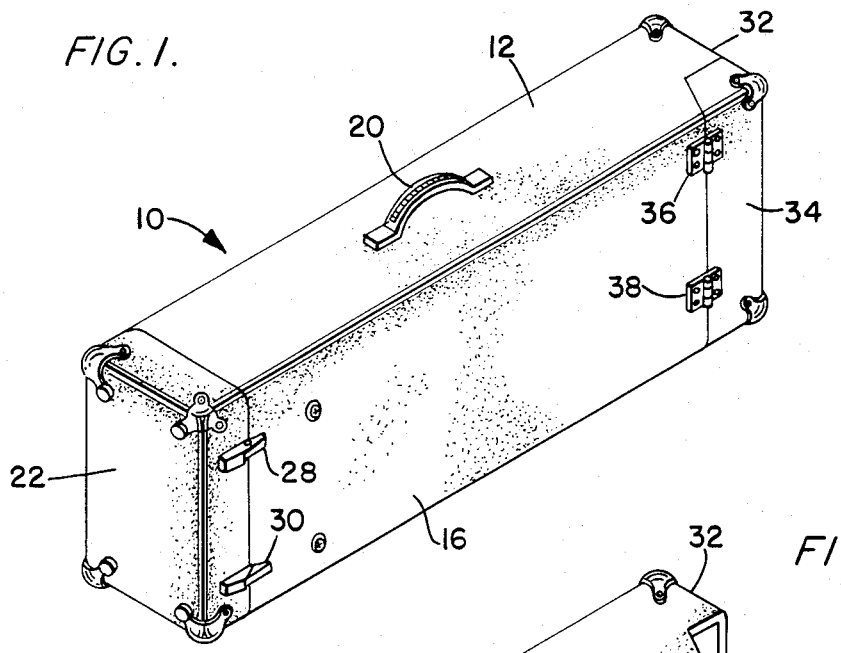
FIG. 1 is a perspective view of the storage case of the present invention.
Figure 2:
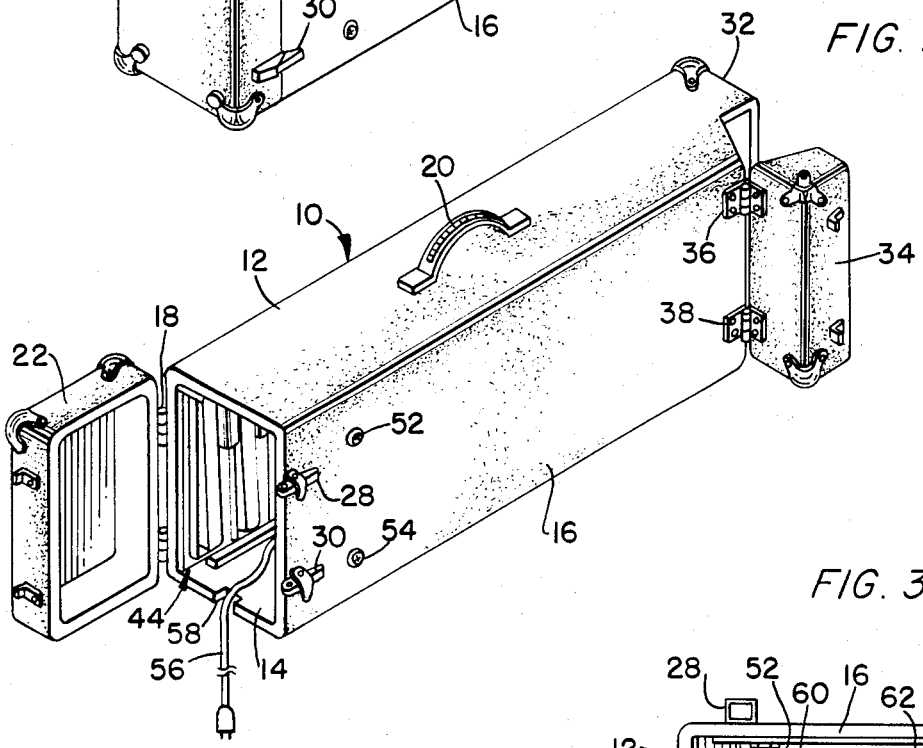
FIG. 2 is a perspective view of the storage case of FIG. 1, opened at both ends.
Figure 3:
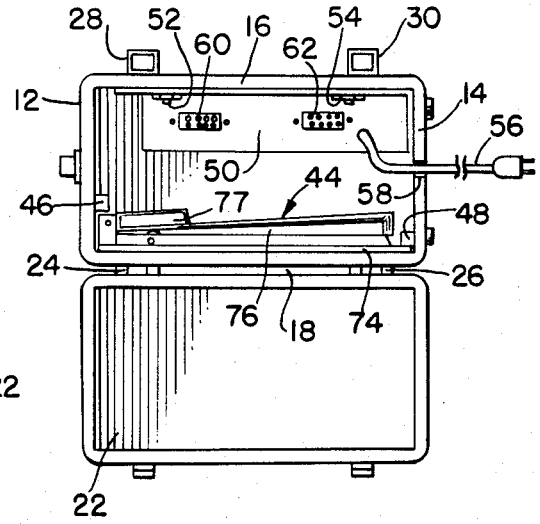
FIG. 3 is an end view of the opened storage case, illustrating the location of the pedal board and electronic components.

Turning now to a more detailed consideration of the present invention, FIG. 1 is a perspective view of a storage case 10 adapted to receive and store a pedal board for an electronic musical instrument, and adapted to provide a protective housing and permanent mounting for the electronic components which are controlled by the pedal board. The case 10 includes a main body portion formed by a top wall 12, a bottom wall 14 (see FIGS. 2, 3 and 4), and front and back walls 16 and 18, respectively, with a carrying handle 20 secured in conventional to the top wall 12. One end of the case (the left hand end as viewed in FIG. 1) is formed by a storage closure 22 which is connected to the back wall 18 by means of hinges 24 and 26 to open fully to provide access to the interior of the storage case 10, as illustrated in FIG. 2 and 3. Suitable fasteners 28 and 30 of conventional design hold the closure 22 in its closed position, as illustrated in FIG. 1.

The opposite end of the casing (the right hand end as viewed in FIG. 1) is partially closed by an end wall 32, the remainder of the end being closed by a control panel door 34 secured to the front wall 16 by means of hinges 36 and 38 and held in its closed position by suitable fasteners 40 and 42.

Figure 4:
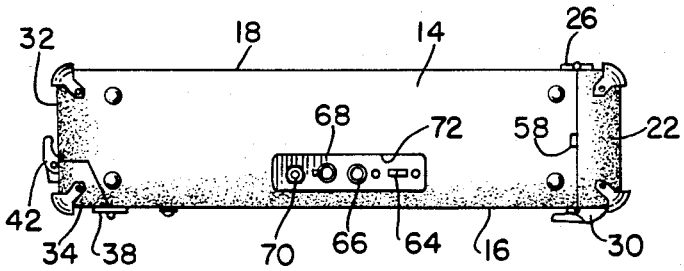
FIG. 4 is a bottom view of the storage case of FIG. 1.
Figure 5:
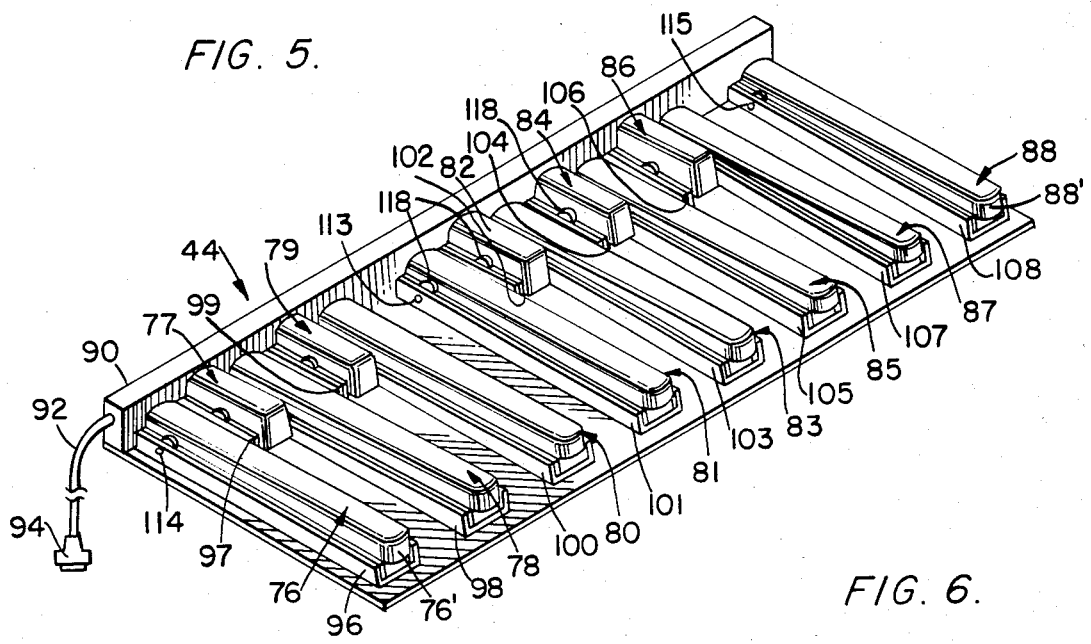
FIG. 5 is a perspective view of the pedal board of the present invention.
Figure 6:
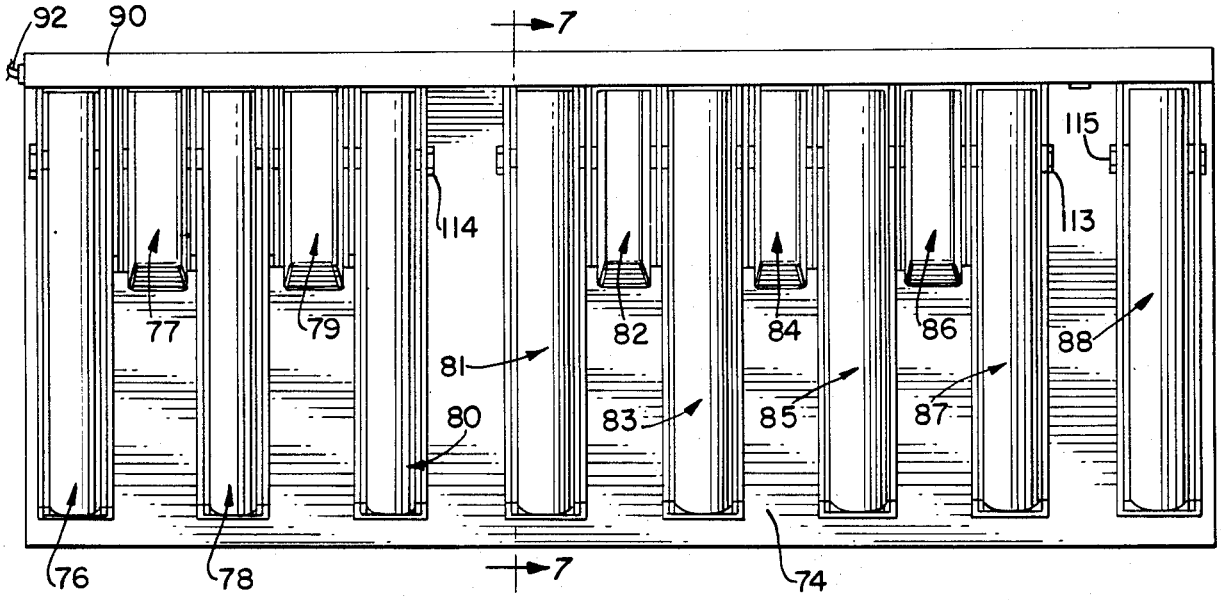
FIG. 6 is a top plan view of the pedal board of FIG. 5.

As illustrated in FIGS. 2 and 3, the storage case 10 receives and stores a musical instrument pedal board 44, which will be described in greater detail with respect to FIG. 5. The pedal board is secured in the storage case by means of longitudinally extending blocks 46 and 48 which engage the pedal board, allowing the board to slide lengthwise into and out of the box when the closure 22 is opened, but preventing the board from otherwise moving within the box. As most clearly illustrated in FIG. 3, the electronics for the musical instrument, which may include tone generators, amplifiers, and the like, are mounted within a housing 50 secured in the storage case by means of suitable fasteners 52 and 54. A power supply cord 56 for the electronics is normally stored within the case 10, but may be extended out of the casing through a groove 58 formed in the edge of the bottom wall 14. Housing 50 also includes a pair of receptacles 60 and 62 adapted to receive corresponding connector plugs by means of which the pedal board 44 and a control panel (to be described) are connected into the electronic circuitry. Access to a power switch 64, a fuse 66, a main volume control 68 and an output jack 70 mounted on the side of housing 50 is by way of an aperture 72 in the bottom wall 14 of case 10 (FIG. 4).

The pedal board 44 is illustrated in greater detail in FIGS. 5 through 8, to which reference is now made. The board includes a base plate 74 of a relatively heavy material such as steel which serves to hold the pedal board in place, while providing a low profile for the pedals. Mounted on the top surface of base plate 74 is a series of pedals 76 through 88, the pedals being mounted side-by-side in a conventional foot-pedal array of long and short keys. Extending across the rear edge of base plate 74 is a cable housing 90 which receives wiring from the contacts (to be described) which are operated by the pedal keys, these wires being connected to the electronic circuitry for the instrument by way of a cable 92, a connector 94, and the previously-described socket 60 (FIG. 3). The pedals are mounted in a spaced array across the width of the pedal board base plate with the rearward end of each pedal located adjacent the cable housing 90.

Figure 8:
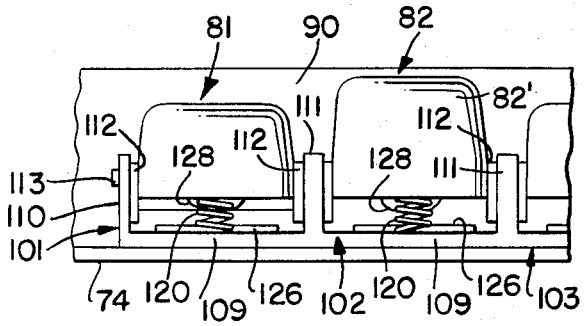
FIG. 8 is partial front elevation of the pedal board of FIG. 5.

Each of the pedals 76 through 88 includes a corresponding pedal key 76′ through 88′ mounted within a corresponding one of U-shaped guide channels 96 through 108, respectively. As indicated in FIG. 8, each guide channel is formed by a bottom wall 109, and opposed side walls 110 and 111. The side walls 110 and 111 of each guide channel carry elongated strips of felt or other resilient cushioning material, indicated at 112 in FIG. 8. These strips extend substantially the full length of the side walls for each channel, except for the area where the pedal key is pivotally connected to the side walls, and are thick enough to provide a snug fit between the pedal key and its guide channel so as to prevent vibration and to provide a smooth operation of the pedal.

The pedal keys 76′ through 88′ preferably are constructed of wood or plastic, while the channel members 96 through 108 preferably are of extruded aluminum or other metal. Other materials may be used, as long as they are sufficiently strong to withstand the abuse to which foot pedals are subject, for such units are frequently stepped on with the full weight of the player, or are accidentially kicked. The cushioned guide channels not only guide the pedal keys, in their vertical motion, but provide lateral strength so that the keys are not displaced or broken.

Figure 7:
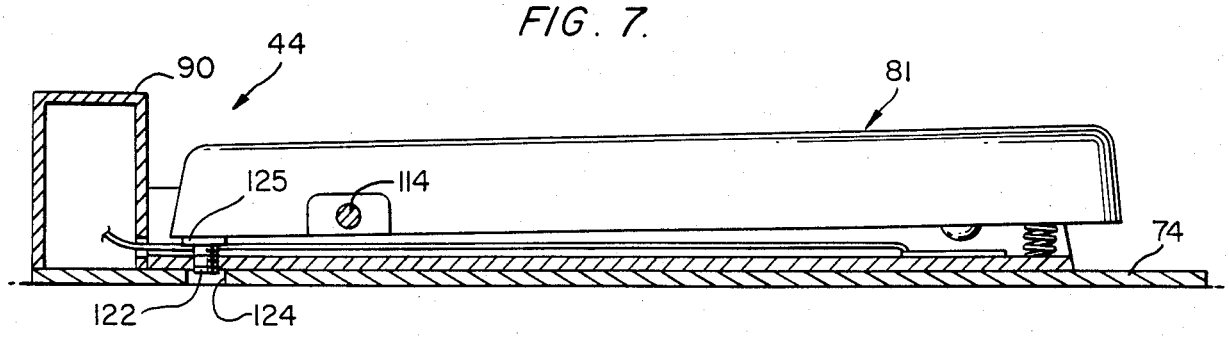
FIG. 7 is a sectional view of the pedal board of FIG. 6 taken along line 7—7.

A typical mounting for the pedal keys is illustrated in FIGS. 7 and 8, wherein pedal 81 is shown with its pedal key 81′ pivotally mounted in channel 101 by means of a shaft 113. Preferably, this shaft passes through the pedal keys and is journalled in the corresponding guide channels of pedals 81 through 87, and shown in FIG. 5. In similar manner, a shaft 114 (FIG. 5) passes through and pivotally supports pedal keys 76′ through 80′ in their corresponding guide channels 96–100, 116 passes through and pivotally supports pedal key 88′ in its guide channel 108. Each pedal key is positioned between, and longitudinally aligned with the side walls of its corresponding guide channel by means of suitable spacers such as washers or raised shoulder portions 118 (FIG. 7) located on each side of the pedal key and surrounding the apertures through which the pivot shaft passes. The spacers preferably abut directly against the side walls 110 and 111 of the guide channel, with the felt lining 112 being removed at the area of the spacers, so that the pedal key is in proper alignment with the guide channel. By providing shoulder portions or other spacers that are relatively wide, as illustrated in FIG. 7, a substantial area of contact is provided between the shoulders and the side walls of the channel to thereby provide a strong mounting of the pedal key that is resistant to transverse twisting during the time the pedal board is being operated or even when it is accidentally kicked.

The location of the pivot shaft near the rearward end of the pedal key provides a pedal key that can be operated with a very low throw, or vertical motion, and yet provide sufficient clearance at the forward end of the pedal to insure a positive, reliable operation of an electrical switch. The forward end of the pedal key is biased upwardly by means of a coil spring 120 which preferably is secured to the key as by pressing it into an aperture formed in the bottom thereof. The bottom of the coil spring rests on the bottom wall 109 of the channel member 101 to pivot the key counterclockwise around pivot shaft 113 as viewed in FIG. 7. The counterclockwise motion of the key is limited by means of an adjustable stop post 122 threaded through the bottom wall of channel 101, the upper end of which extends into the channel and the lower end of which extends into an access aperture 124 formed in the base plate 74. The upper end of the post is adapted to abut a rubber pad 125 mounted on the lower surface of pedal key 81' to limit the counterclockwise motion of the key. By adjusting the height of post 122, the distance between the forward end of the key and the bottom wall of the channel, and thus the throw of that key, is determined.

Mounted to the bottom wall 109 of guide channel 101, near the forward end thereof, is a conventional pressure-sensitive solid state switch 126. Preferably, this is a conventional membrane type switch wherein a printed circuit board is covered by a mylar membrane carrying on its lower surface a conductive film. The membrane is normally spaced from the circuit board, but when pressure is applied to the membrane, the conductive film short-circuits a pair of contacts on the circuit board, closing the contacts to complete an electric circuit. This switch is activated by means of a switch contact operator 128 mounted on the lower surface of the pedal key 81'. Preferably, the contact operator is made of a resilient material such as rubber so that the switch will not be damaged by excessive pressure caused, for example, when a player stands with his full weight on the pedal board. Although other switch arrangements may be used, the above-described switch is preferred since it can readily be sealed against moisture and thus is reliable and long lasting.

Switch 126 is connected by way of conductors 130 and 132, which pass into the cable housing 90, to the connector cable 92, as previously described. The location of the contact 126 at the forward end of the pedal together with the location of the pivot shaft near the rearward end of the key insures a maximum amount of vertical motion for the key for operation of the contact, while still providing a low throw pedal.

Figure 9:
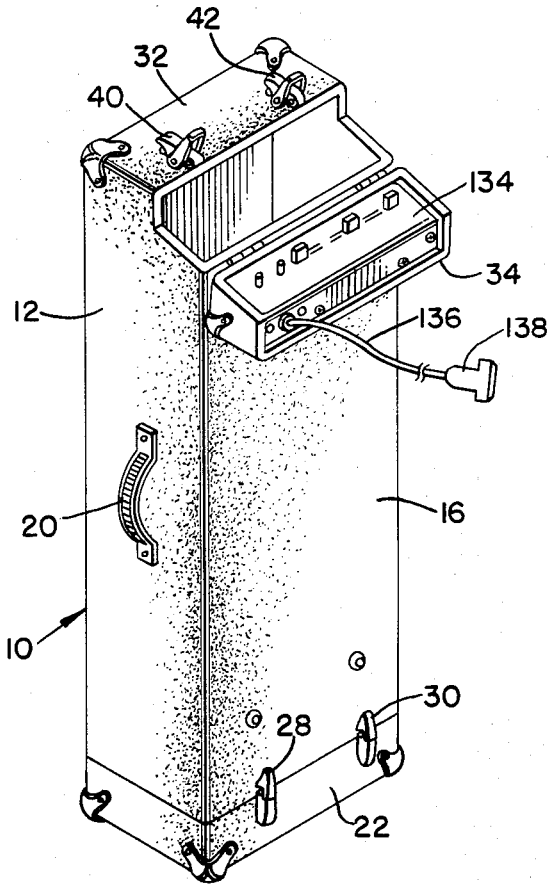
FIG. 9 is a perspective view of the case of FIG. 1 serving as a control panel stand.

Referring now to FIG. 9, the storage case 10 is illustrated with the end closure 22 in the closed position and the control panel door 34 pivoted to its fully opened position to display a control panel 134 mounted within the L-shaped door 34. The control panel includes conventional electronic musical instrument controls such as "volume", "sustain", and "voicing" controls as well as damper and attack controls which serve to regulate the sound produced by the instrument. These controls are connected by way of a control cable 136 and connector 138 to the instrument electronics contained in housing 50, by way of receptacle 62.

Pedal board 44 is normally stored within storage case 10, but is easily removable to permit a rapid assembly of the electronic musical instrument. To prepare the device for use, the pedal is removed from the case and positioned, for example, under a piano in front of the piano bench for easy access by the pianist. The cable 92 is fed through the groove 58 in the edge of the bottom wall 14 and is plugged into receptacle 60. In similar manner, the power cord 56 is fed through groove 58 and secured in a suitable power outlet. Finally, the control panel door 34 is opened and pivoted about its hinges to display the control panel 34. The control panel cable 136 is fed down through the groove 58, and connector plug 138 is plugged into receptacle 62. The closure 22 may then be secured in its closed position by means of fasteners 28 and 30 and the storage case 10 may be upended to stand uprightly on closure 22 in a manner illustrated in FIG. 9. With the closure segment 34 pivoted to its open position as illustrated in that figure, the control panel 134 is readily accessible to the pianist or other user of the string bass instrument.

The hinges 36 and 38 which secure the door 34 to the storage case 10 are readily separable so that the door may easily be removed from case 10 to allow the control panel to be mounted at another location, if desired. Thus, for example, a suitable bracket may be provided to enable the control panel to hang on the piano keyboard panel or at any other location on a piano or other instrument for the convenience of the instrumentalist. However, the case 10 is of a height to conveniently locate the control panel for an instrumentalist when the panel is still secured to the case in the nammer illustrated in FIG. 9, and thus this is the preferred arrangement.

Although the present invention has been described in terms of preferred embodiment, it will be apparent that numerous variations may be made without departing from the true spirit and scope of the invention as set forth in the following claims:

What is claimed is:

1. An electronic musical instrument comprising:

a compact, portable pedal board;

an elongated storage case adapted to removably receive said pedal board, said storage case including at one end a pedal board access door and at the opposite end a control panel door;

electronic circuit means controllable by said pedal board for electronically producing music, said circuit means being mounted within said storage case;

a control panel for said circuit means, said control panel being mounted on said control panel door for display when said control panel door is open; and cable means for connecting said pedal board and said control panel to said electronic circuit means.

2. The electronic musical instrument of claim 1, wherein said pedal board comprises:

a base plate;

a plurality of pedals mounted on said base plate, each said pedal including a pedal key pivotally mounted at its rearward end in a corresponding, individual pedal guide channel;

a pressure responsive switch mounted at the forward end of each said pedal key for activation by its corresponding pedal key, the relative location of the pivotal mount with respect to the location of the pressure responsive switch for each key providing a pedal key having a low throw; and bias means for urging each said pedal key in a direction to deactivate its corresponding pressure responsive switch.

3. The electronic musical instrument of claim 2, wherein each said pedal further includes adjustable stop means for regulating the throw of its pedal key.

4. The electronic musical instrument of claim 3, wherein each of said pedal keys is pivotally mounted in its corresponding guide channel by means of a pivot shaft extending through the guide channel, and wherein the pivot shaft is located near the rearward end of the pedal key.

5. The electronic musical instrument of claim 4, wherein each said guide channel is generally U-shaped in cross-section and is formed by a bottom wall and upstanding side walls, each said pedal further including resilient means secured to the side walls of said guide channel and abutting said pedal key.

6. The electronic musical instrument of claim 5 wherein said pedal board further includes cable housing means adjacent the rearward ends of said pedals.

7. The electronic musical instrument of claim 2, wherein each said pedal further includes resilient actuator means for its corresponding pressure responsive switch.

8. The electronic musical instrument of claim 7, wherein said pressure responsive switch is mounted on said guide channel near the forward end thereof, and said resilient actuator means is mounted on the lower surface of said pedal key near the forward end thereof, whereby pressure applied to the top surface of said pedal key pivots the forward end thereof downwardly to activate said pressure sensitive switch.

9. A compact, portable, low profile pedal board adapted for use in an electronic musical instrument, comprising:

a base plate;

a plurality of foot operable pedals mounted on said base plate, each said pedal including a pedal key pivotally mounted at its rearward end in a corresponding, individual pedal guide channel which is coextensive with said pedal key;

a pressure responsive switch mounted at the forward end of each said pedal key for activation by its corresponding pedal key, the relative location of the pivotal mount at the rearward end of each pedal key with respect to the location of the pressure responsive switch at the forward end of the pedal key providing a pedal key having a low throw;

bias means for urging each said pedal key in a direction to deactivate its corresponding pressure responsive switch; and adjustable stop means for each said pedal key for regulating the throw of said pedal key.

10. The pedal board of claim 9, wherein each of said pedal keys is pivotally mounted in its corresponding guide channel by means of a pivot shaft extending through said guide channel, and wherein the pivot shaft is located near the rearward end of the pedal key.

11. The electronic musical instrument of claim 9, wherein each said pedal further includes resilient actuator means for said pressure responsive switch.

12. The electronic musical instrument of claim 11, wherein said pressure responsive switch is mounted on said guide channel near the forward end thereof, and said resilient actuator means is mounted on the lower surface of said pedal key near the forward end thereof, whereby pressure applied to the top surface of said pedal key pivots the forward end thereof downwardly to activate said pressure sensitive switch.

13. A compact, portable, low profile pedal board adapted for use in an electronic musical instrument, comprising:

a bias plate;

a plurality of foot operable pedals mounted on said base plate, each said pedal including a pedal key pivotally mounted at its rearward end in a corresponding, individual pedal guide channel which is coextensive with said pedal key, wherein said guide channel is generally U-shaped in cross-section and is formed by a bottom wall and upstanding side walls;

resilient means secured to the side walls of each said guide channel and abutting substantially the entire length of its corresponding pedal key;

a pressure responsive switch mounted at the forward end of each said pedal key for activation by its corresponding pedal key, the relative location of the pivotal mount at the rearward end of each pedal key with respect to the location of the pressure responsive switch at the forward end of the pedal key providing a pedal key having a low throw; and bias means urging each said pedal key in a direction to deactivate its corresponding pressure responsive switch.

14. The pedal board of claim 13, further including cable housing means adjacent the rearward ends of said pedals.

15. The pedal board of claim 13, wherein said pedal key includes spacer means for aligning said pedal key within said guide channel means.

16. The pedal board of claim 15, wherein said spacer means comprises shoulders formed on opposite sides of said pedal key and adapted to abut the side walls of said guide channel.

17. A pedal for an electronic musical instrument comprising:

a guide channel generally U-shaped in cross-section and formed by a base and opposed upstanding side walls;

a pedal key;

a pivot shaft passing through said pedal key and through said side walls of said guide channel for pivotally mounting said pedal key for vertical motion within said guide channel;

spacer means on opposite sides of said pedal key to align said pedal key within said guide channel;

resilient means secured between said side walls of said guide channel and said pedal key;

pressure sensitive switch means mounted for activation by the vertical motion of said pedal key within said guide channel;

bias means urging said pedal key in a direction to deactivate said switch means;

resilient actuator means for activating said switch means upon pivotal motion of said pedal key; and adjustable stop means for regulating the throw of said pedal key.

* * * * *